US005403644A

United States Patent [19]

Fujisawa et al.

[11] Patent Number: 5,403,644

[45] Date of Patent: Apr. 4, 1995

[54] FRAYLESS NATURAL FABRIC

[75] Inventors: Mitsuo Fujisawa, 1-6, Maeishiki 1-chome, Gifu-City, Gifu, Japan, 600; Akira Watanabe, Gifu, Japan

[73] Assignee: Mitsuo Fujisawa, Gifu, Japan

[21] Appl. No.: 53,148

[22] Filed: Apr. 27, 1993

[30] Foreign Application Priority Data

| | | | |
|---|---|---|---|
| Apr. 28, 1992 | [JP] | Japan | 4-110115 |
| May 16, 1992 | [JP] | Japan | 4-149950 |
| Dec. 28, 1992 | [JP] | Japan | 4-347757 |
| Dec. 28, 1992 | [JP] | Japan | 4-347758 |

[51] Int. Cl.[6] ..... B32B 3/10; B32B 23/02; D05C 17/00

[52] U.S. Cl. ..... 428/137; 112/439; 139/383 R; 428/131; 428/134; 428/192; 428/193; 428/224; 428/297; 428/906.6

[58] Field of Search ..... 428/131, 134, 192, 193, 428/224, 137, 297, 906.6; 112/439; 139/383 R

[56] References Cited

U.S. PATENT DOCUMENTS

| | | | |
|---|---|---|---|
| 1,773,967 | 8/1930 | Dreyfus | 428/192 |
| 3,620,803 | 4/1971 | Lineberger | 428/193 |
| 3,852,144 | 12/1974 | Parry | 156/510 |
| 3,939,033 | 2/1976 | Grgach et al. | 156/515 |
| 3,971,868 | 7/1976 | Murai | 428/194 |
| 4,097,327 | 6/1978 | Calemard | 156/515 |
| 4,788,972 | 12/1988 | DeBusk | 128/89 R |
| 4,879,155 | 11/1989 | Fujisawa | 428/131 |
| 5,085,917 | 2/1992 | Hodnett, III | 428/193 |

FOREIGN PATENT DOCUMENTS 63-144537 3/1985 Japan .

*Primary Examiner*—James D. Withers
*Attorney, Agent, or Firm*—Lorusso & Loud

[57] ABSTRACT

A fabric to be utilized in making a textile product is prepared in the steps comprising: embroidering a natural fabric along the predetermined cutting line and/or patterns with thermofusing fibers; and melt cutting and/or pressingly welding along said embroidered portions with a supersonic treating machine to provide frayless edge portions and/or openings as well as hollow patterns. Another fabric is prepared in the steps comprising: providing at least one surface of a natural fabric with a thermofusing fabric; and melt-cutting and/or pressingly welding along the predetermined cutting line and/or patterns with a supersonic treating machine.

4 Claims, 13 Drawing Sheets

FRAYLESS NATURAL FABRIC

BACKGROUND OF THE INVENTION

The present invention relates to natural fabrics whose edges are treated frayless supersonically. The invention more particularly relates to natural fabrics whose edges are designingly configured in addition to being frayless by supersonical treatment. The invention also particularly relates to natural fabrics on which hollow patterns and/or openings are provided frayless by supersonical treatment.

Most conventional natural fabrics are provided with sewn lapel portions on their edges so that fraying of the edges can be prevented. Provision of such sewn lapel portions on the natural fabrics, however, is time consuming and the lapel portions provided thereon often cause certain inconveniences to the manufacturers for further processes as well as to the users of the products made from the fabrics with sewn lapel portions.

Another problem with sewn lapel portions is that it is extremely difficult to freely provide such sewn lapel portions with ornamentation, which has long been an obstacle to decoration of natural fabric products.

SUMMARY OF THE INVENTION

A fabric comprised of natural fibers according to the present invention is provided in the steps the comprising: embroidering along the predetermined cutting line on a naturalfabric with thermofusing fibers; and melt-cutting along said embriodered cutting line with a supersonic treating machine, providing frayless edges without lapel portions.

Another fabric comprised of natural fibers according to the present invention is provided in the steps comprising: embroidering along the predetermined patterns on a natural fabric with thermofusing fibers; and melt-cutting and/or pressingly welding along said embroidered patterns with a supersonic treating machine, providing frayless openings and/or hollow patterns.

Another fabric comprised of natural fibers according to the present invention is provided in the steps comprising: providing at least one surface of a natural fabric with another fabric comprised of thermofusing fibers; and melt-cutting along the predetermined cutting line on the dual or triple layer fabric with a supersonic treating machine, providing frayless edges without lapel portions.

Another fabric comprised of natural fibers according to the present invention is provided in the steps comprising: providing at least one surface of a natural fabric with another fabric comprised of thermofusing fibers; and melt-cutting and/or pressingly welding along the predetermined patterns on the dual or triple layer fabric with a supersonic treating machine, providing frayless openings and/or hollow patterns.

Another fabric comprised of natural fibers according to the present invention is provided in the steps comprising: providing at least one surface of a natural fabric with another fabric comprised of thermofusing fibers; embroidering along the predetermined cutting line on the dual or triple layer fabric with thermofusing fibers; and melt-cutting along said embroidered cutting line with a supersonic treating machine, providing frayless edges without lapel portions.

Another fabric comprised of natural fibers according to the present invention is provided in the steps comprising: providing at least one surface of a natural fabric with another fabric comprised of thermofusing fibers; embroidering along the predetermined patterns on the dual or triple layer fabric with thermofusing fibers; and melt-cutting and/or pressingly welding along said embroidered patterns with a supersonic treating machine, providing frayless openings and/or hollow patterns.

Another fabric comprised of natural fibers according to the present invention is provided in the steps comprising: blending the periphery zone portions of a natural fabric with thermofusing fibers; and melt-cutting along the predetermined line within said periphery zone portions with a supersonic treating machine, providing frayless edges without lapel portions.

Still another fabric comprised of natural fibers according to the present invention is provided in the steps comprising: blending the periphery zone portions of a natural fabric with thermofusing fibers; and melt-cutting and/or pressingly welding along the predetermined patterns within said periphery zone portions with a supersonic treating machine, providing frayless openings and/or hollow patterns.

Another fabric comprised of natural fibers according to the present invention is provided in the steps comprising: blending a portion or portions of a natural fabric with thermofusing fibers; and melt-cutting and/or pressingly welding along the predetermined patterns within said portion or portions of the natural fabric with a supersonic treating machine, providing frayless openings and/or hollow patterns within said portion or portions.

A supersonic treating machine to be used for the aforedescribed treatments chiefly comprises cutting blades, welding blades and a supersonic wave generating horn, whereas said cutting blades melt thermofusing fibers and cut a natural fabric in a configuration or configurations and said welding blades pressingly weld thermofusing fibers onto the natural fabric when given vibrating energy by said supersonic wave generating horn. The melted fibers cover the cut portions and securely prevent fraying of the cut portions.

Accordingly, it is an object of the present invention to provide a natural fabric with frayless edges without lapel portions.

It is another object of the present invention to provide a natural fabric with an improvement in usability of the fabric by eliminating bulky lapel portions.

It is another object of the present invention to provide natural fabric with a richer variety of designed patterns.

It is still another object of the present invention to provide a natural fabric with an easy and reliable cutting.

It is yet another object of the present invention to improve productivity in manufacturing natural fabric products.

Additional features and advantages of the present invention will become apparent to those skilled in the art from the following description and the accompanying figures illustrating the preferred embodiments of the invention.

DETAILED DESCRIPTION OF THE PREFERRED EMBODIMENTS

Embodiment 1

Figure 1:
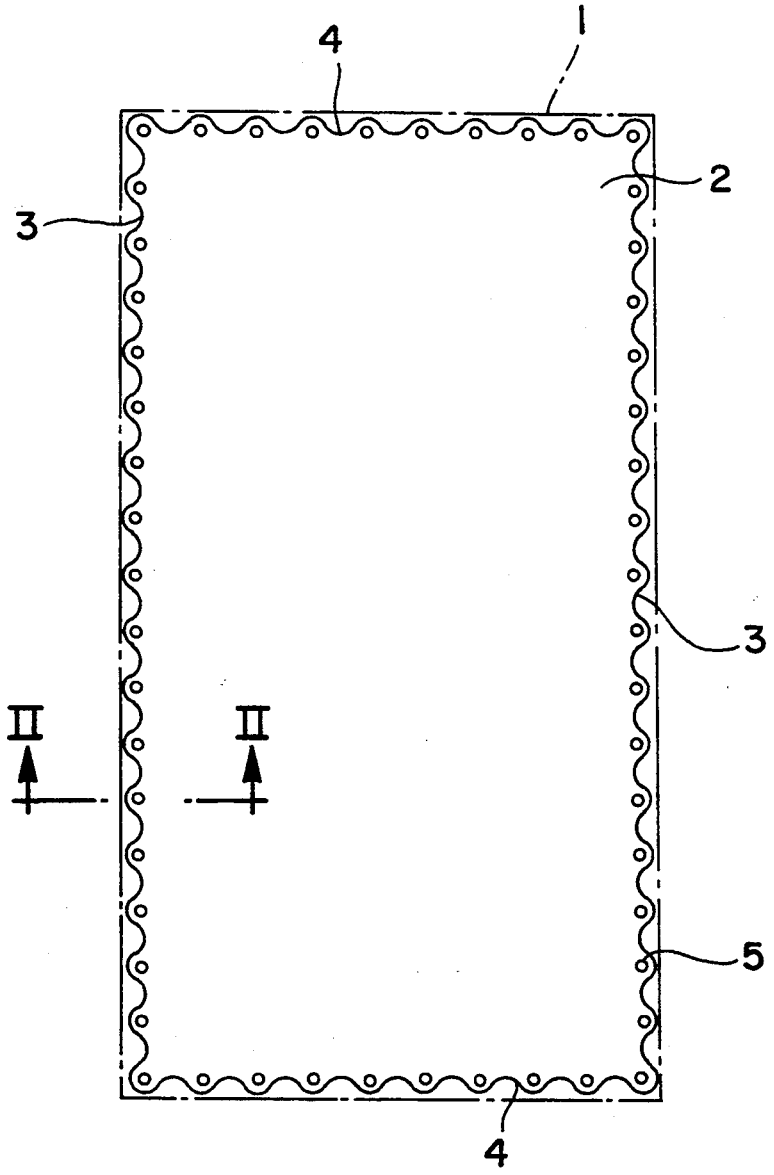
FIG. 1 is a plan view of a fabric to be prepared according to an embodiment of the present invention showing an edge configuration and hollow patterns thereon.
Figure 2:
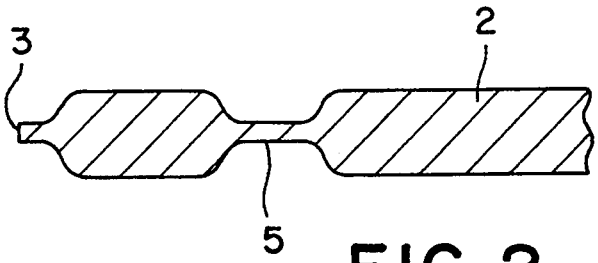
FIG. 2 is a partial sectional view showing the section of the fabric in FIG. 1 cut along line II—II.

The fabric 1 partially shown in FIG. 1 comprises natural fibers such as cotton fibers and is to be used in Embodiment 1 to make a towel 2. The fabric 1 is to be treated with a supersonic treating machine along the predetermined edge line portions 3 and 4 and is provided also with hollow patterns 5 as shown in FIG. 1.

A towel 2 according to the present invention is prepared out of the fabric 1 in the steps comprising:

(a) embroidering along the edge line portions 3 and 4 as well as along the hollow design patterns 5 with thermofusing fibers such as synthetic fibers; and (b) melt-cutting said edge line portions 3 and 4 and pressingly welding said hollow patterns 5 either with a supersonic sheet treating machine 20 proposed by the inventor Japanese Patent Publication No. 3-42344 or with a supersonic edge ornamentation machine 30 proposed by the inventor in Japanese Patent Publication Unexamined No. 2-61171.

Figure 3:
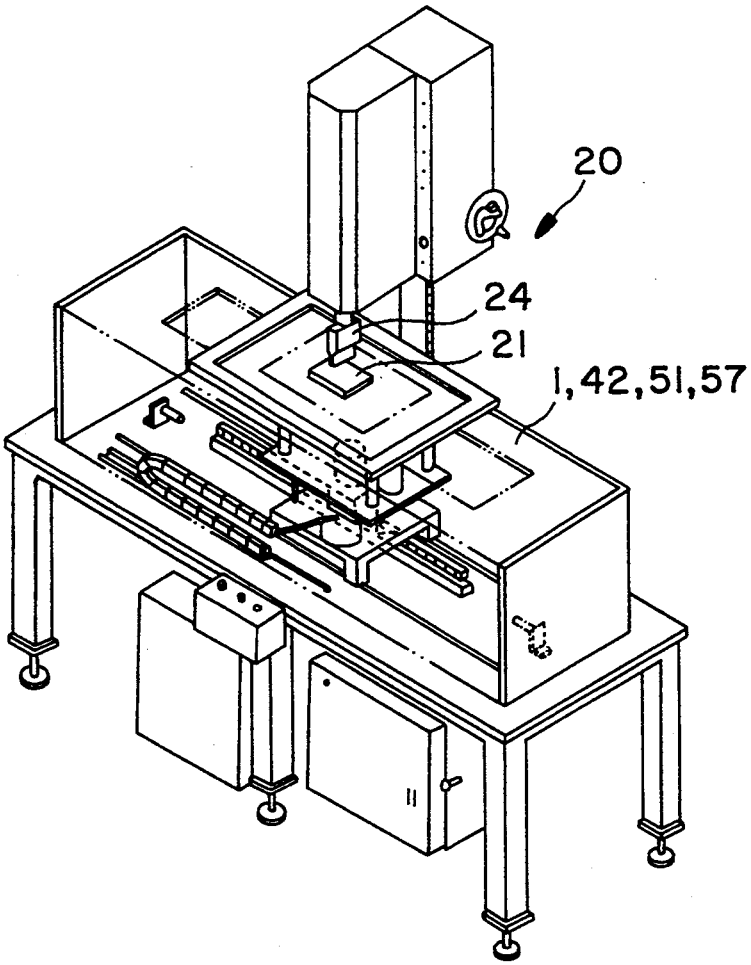
FIG. 3 is a perspective view of a supersonic treating machine (supersonic sheet treating machine).
Figure 4:
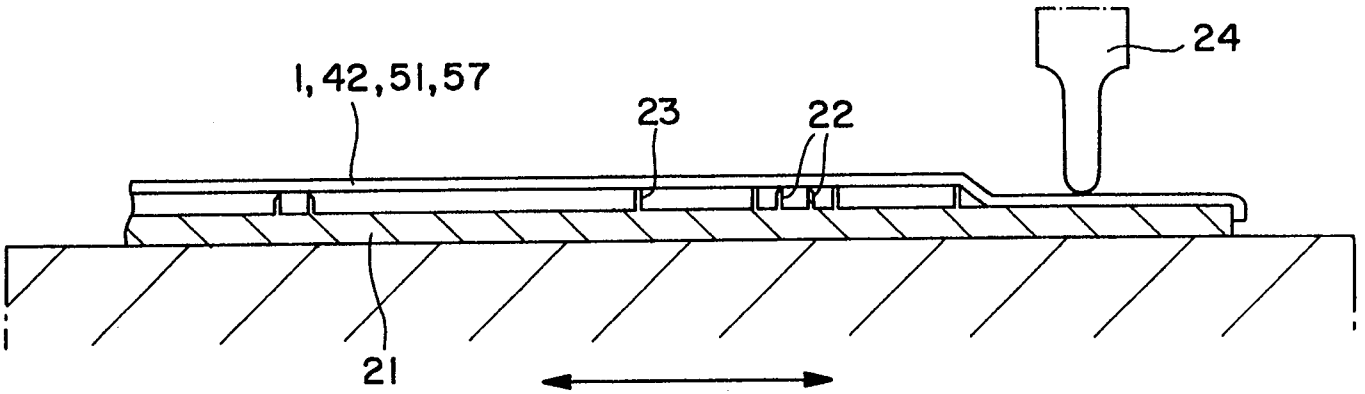
FIG. 4 is a partial sectional view showing a fabric on the designed plate having blades in the supersonic treating machine of FIG. 3.

The supersonic sheet treating machine 20 is to be utilized as in the following. As shown in FIGS. 3 and 4, an embroidered fabric 1 is placed on the pattern plate 21 of the machine 20 having sharp melt-cutting blades 22 and flat-pointed welding blades 23, whereas said melt-cutting blades 22 are to form edge line portions 3 and 4, and said welding blades 23 are to form hollow patterns 5. The supersonic wave generating horn 24 of the machine 20 is pressed against the fabric 1 on the plate 21, which vibrates supersonically, having said blades 22 melt-cut the fabric 1 along said edge line portions 3 and 4 and said blades 23 produce said hollow patterns 5. The embroidered fibers when melted stick onto the cut portions 3 and 4 and prevent the cut portions 3 and 4 from fraying. A towel 2 having frayless design edges and design hollows is thus prepared.

Figure 5:
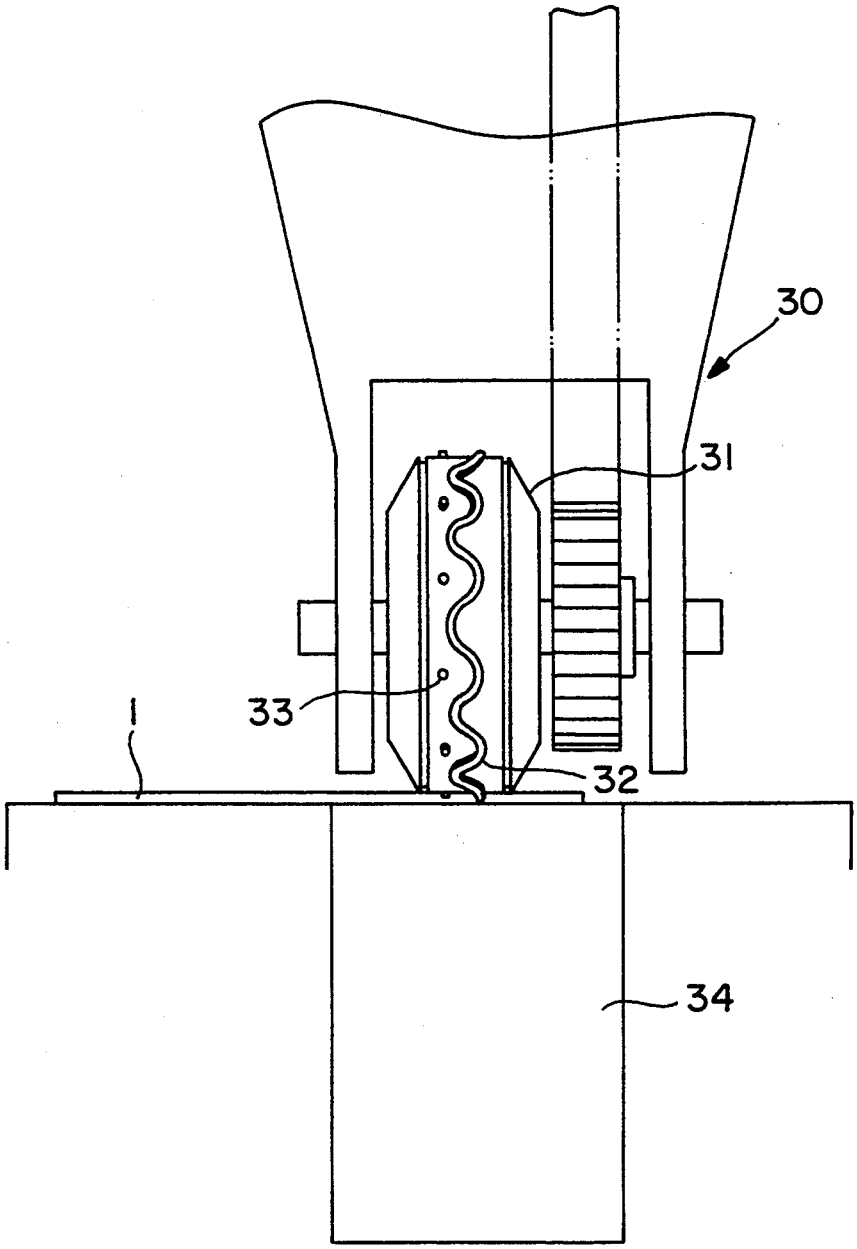
FIG. 5 is a partial front view of another supersonic treating machine (supersonic edge ornamentation machine).
Figure 6:
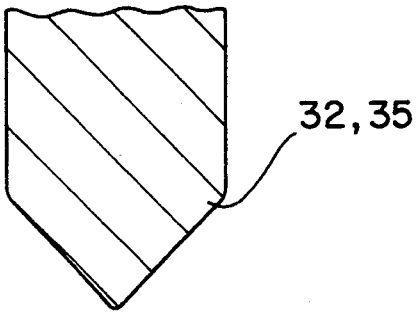
FIG. 6 is a partial sectional view of a melt-cutting blade point used in the supersonic treating machine of FIG. 5.

A towel according to the present invention can also be produced using said supersonic edge ornamentation machine 30, which is utilized as follows. As shown in FIG. 5, an embroidered fabric 1 is placed in the machine 30 between the drum 31 having both a sharp edged melt-cutting wavy blade 32 and dot-like welding blades with a flat blade point 33 and the supersonic wave generating horn 34 of the machine 30. FIG. 6 shows a section of the blade point of such a wavy blade 32. The horn 34 provides supersonic wave vibrations to the fabric 1 and the blades 32 and 33. As the drum 31 revolves and the fabric 1 travels in harmony, the blades 32 melt-cut the fabric 1 along the pattern line portions 3 and 4 while the blades 33 provide the fabric 1 with hollow patterns 5. The embroidered fibers melt and stick onto the cut portions 3 and 4, preventing the cut edge portions 3 and 4 of the fabric 1 from fraying. The hollows 5 do not fray, either. A towel 2 having frayless design edges and design hollows is thus prepared.

Fraying of the fabric edges 3 and 4 is prevented as the embroidered fibers are melted by the high temperature provided by means of the vibration energy from the supersonic wave generation horn 24 or 34, which stick onto the cut portions 3 and 4. The fabric 1 is cut along the edge line portions 3 and 4 with the melt-cutting blades 22 or 32 whose blade point is made sharp. The hollow patterns 5 are provided on the fabric 1 concurrently with the provision of the edge line portions 3 and 4.

The supersonic sheet treating machine 20 as well as the supersonic edge ornamentation machine 30 can change the numbers of the vibrations of its horn 24 (34), which in turn changes the temperature to be provided on its blades. Therefore, the treatment temperature of the fabric 1 can be easily control led in accordance with the materials of the fabric 1 to be treated. The cutting performance of the machines 20 and 30 can be improved by simply sharpening the blade points and/or increasing the blade pressure against a fabric 1 to be treated. There is, therefore, practically no fear of excessive melting or burning of fabrics 1.

Towels thus prepared do not only fray on their edges but are not bulky in their edge portions as conventional towels are. In addition, designed edge configurations can be easily and nearly freely provided just by modifying the shape and/or the arrangement of the blades.

Embodiment 2

Figure 7:
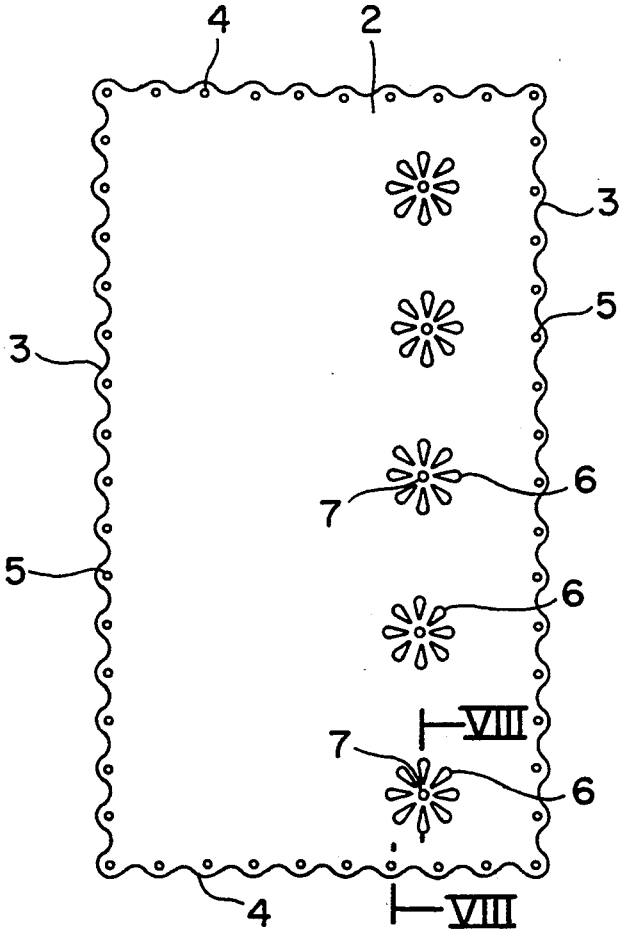
FIG. 7 is a plan view of another fabric prepared according to another embodiment of the present invention.
Figure 8:
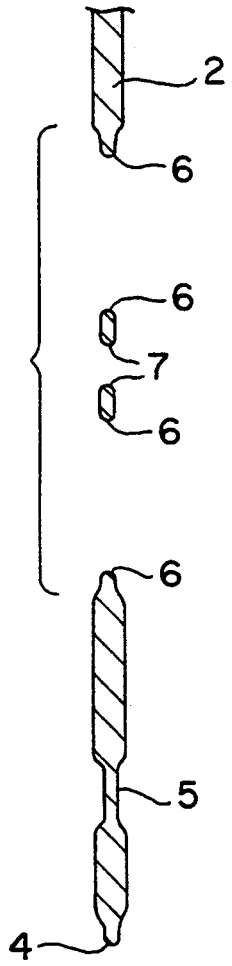
FIG. 8 is a partial sectional view showing the section of the fabric in FIG. 7 cut along line VIII—VIII.

FIGS. 7 and 8 show Embodiment 2, in which another towel 2 is prepared according to the present invention. The difference between the towels 2 in Embodiment 1 and 2 is that the towel 2 in this embodiment 2 is additionally provided with flowery pattern configurations 6 and tiny holes 7, producing a more complicated and artistic appearance. Said flowery configurations 6 can be provided using either a supersonic sheet treating machine 20 or a supersonic edge ornamentation machine 30 proposed by the inventor. Towels 2 made in accordance with this embodiment do not fray without any further treatment.

Embodiment 3

Figure 9:
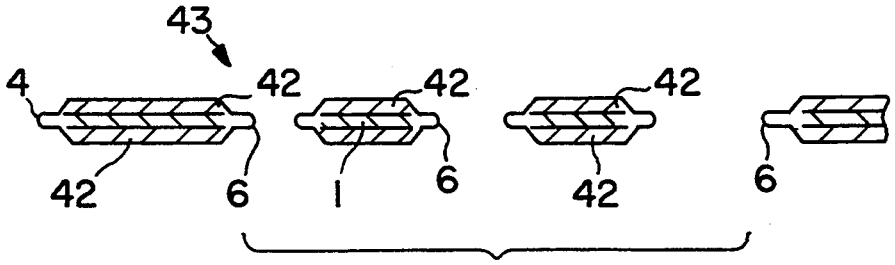
FIG. 9 is a partial sectional view showing the section of the fabric in FIG. 10 cut along line IX—IX.
Figure 10:
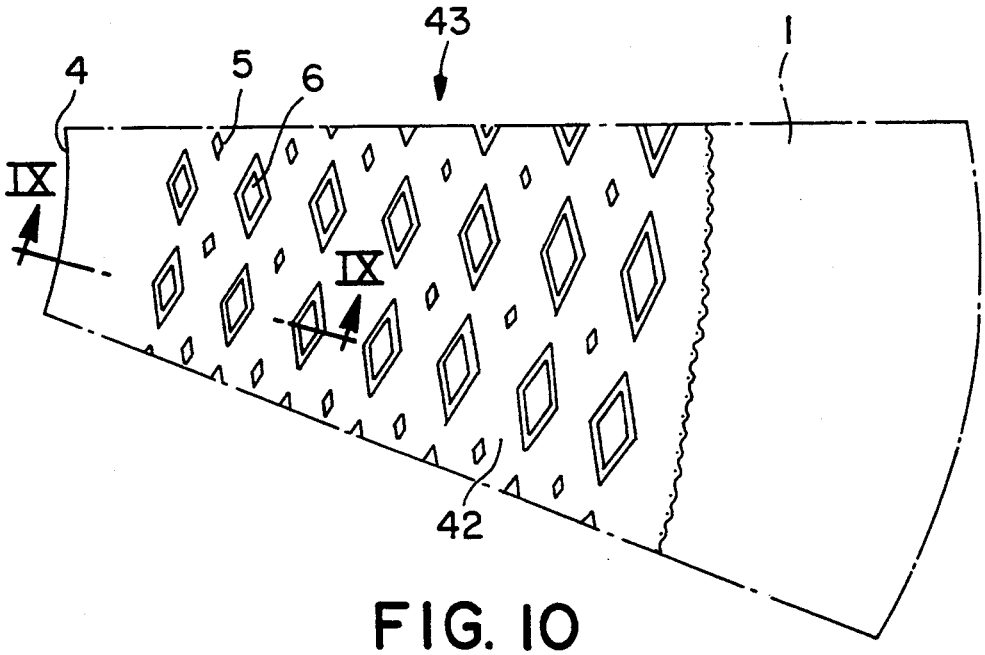
FIG. 10 is a partial plan view of a fabric prepared according to another embodiment of the present invention.

A blouse can be prepared according to the present invention in Embodiment 3. FIGS. 9 and 10 show a fabric 1 comprising natural fiber warps and wefts, which is sandwitched by thermofusing fabrics 42 as shown in FIG. 9. The fabric material for a blouse 43 is prepared by melt-cutting the sandwitched fabric along the neck line 4 and also forming hollow patterns 5 and openings 6 with a supersonic sheet treating machine 20.

The processes for preparing the fabric material for making a blouse 43 are described in further detail below. The fabric 1 is sandwitched by thermofusing fabrics 42. The edge portions of the thermofusing fabrics 42 are preferredly tentatively fixed to the fabric 1 by some tentative means so as to make the remaining processes easy.

Said hollow patterns 5 and openings 6 are provided by using a supersonic sheet treating machine 20 proposed by the inventor in Japanese Patent Publication No. 3-42344.

Said sandwitched fabric is placed on the plate 21 of the machine 20 as shown in FIG. 4. The supersonic horn 24 of the machine 20 is pressed against the fabric on the plate 21. Said supersonic horn 24 provides supersonic wave vibrations and the blades on the machine 20 melt-cut/weld the fabric on the plate 21. The neck line edge 4, the hollow patterns 5 and the openings 6 are thus formed thereon.

The line 4, the hollow patterns 5 and the openings 6 do not fray since the cut portions are protected by the melted fabric 42. The edge portions treated with the machine 20 are not bulky, while the corresponding edge portions of conventional fabrics conventionally treated are often uncscapably made bulky to prevent fraying.

Since the fabric 1 in this embodiment is a natural material, blouses prepared from said material according to the present invention show an excellent moisture absorptive property as well as an excellent wear feeling. In addition, the blouses of the present invention do not substantially have bulky sewn lapels and therefore they provide a better design appearance than conventionally treated ones.

Embodiment 4

Figure 11:
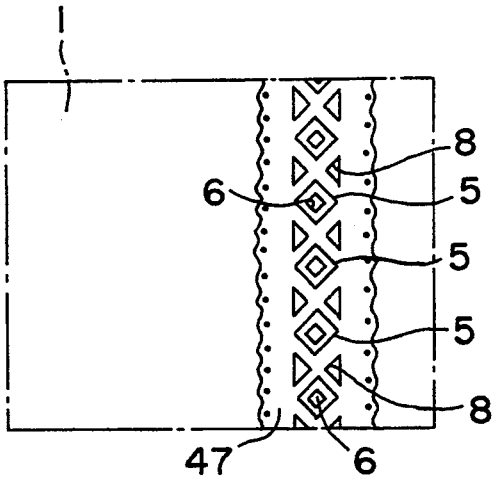
FIG. 11 is a partial plan view of another fabric to be prepared according to another embodiment of the present invention.
Figure 12:
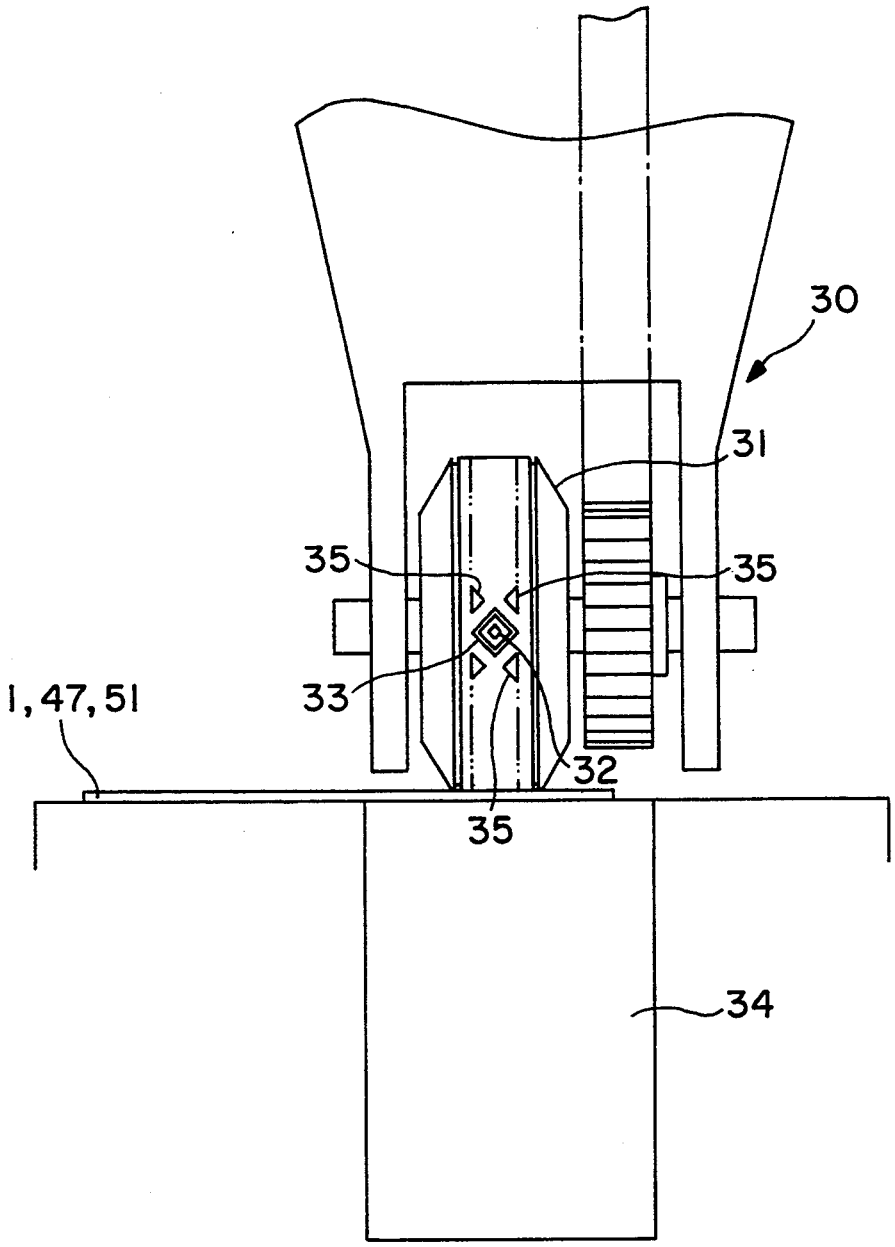
FIG. 12 is a partial front view of another supersonic treating machine (supersonic edge ornamentation machine).

FIGS. 11 and 12 show Embodiment 4 in which decoration patterns for a dress are provided in accordance with the present invention. Thermofusing tapes 47 sandwitch a natural fabric 1. The hollow patterns 5 and openings 6 and 8 are provided where said tapes 47 are provided using a supersonic edge ornamentaion machine 30 proposed by the inventor in Japanese Patent Publication Unexamined No. 2-61171.

As shown in FIG. 12, said machine 30 comprises a drum 31 having both sharp-edged blades 32 and 35 which are configured correspondent to the configurations of the openings 6 and 8 respectively and flat-pointed blades 33 configured correspondent to the configurations of the hollow patterns 5 and a supersonic wave horn 34. The fabric 1 is placed pressedly between said drum 31 (blades 32, 33, 35) and said horn 34. The horn 34 provides the fabric 1 and the drum 31 (blades 32, 33, 35) with supersonic vibrations. The blades 32, 33 and 35 on the drum 31 form the hollow patterns 5 and openings 6 and 8 in the fabric 1. The openings 6 and 8 do not fray since the melted portion of the thermofusing tapes 47 sticks onto the cut portions 6 and 8 and prevents the cuts 6 and 8 from fraying.

A dress made of said fabric 1 according to this embodiment provides a more aesthetical appearance.

Embodiment 5

Figure 13:
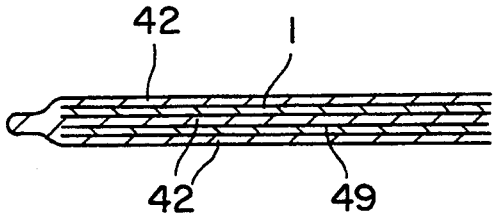
FIG. 13 is a partial sectional view of a fabric supersonically treated according to the present invention.

FIG. 13 shows Embodiment 5, where the present invention is applied on a collar or a lapel of clothing such as a jacket collar which includes a padding. A thermofusing fabric 42 is sandwitched between a natural fabric 1 and a padding 49, which are then sandwitched with thermofusing fabrics 42. The whole fabric is treated with said machine 30. A collar or a lapel for a jacket according to the present invention is thus prepared, whose edges do not fray without any further conventional fray preventive treatment.

Embodiment 6

Figure 14:
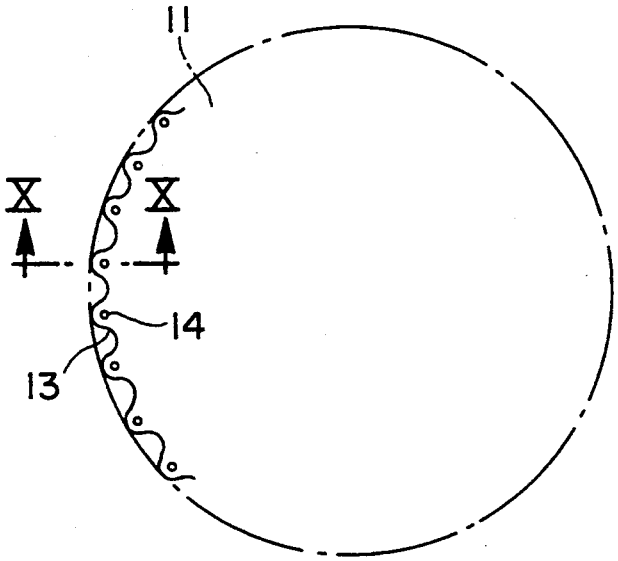
FIG. 14 is a partial plan view of another fabric to be prepared according to another embodiment of the present invention.
Figure 15:
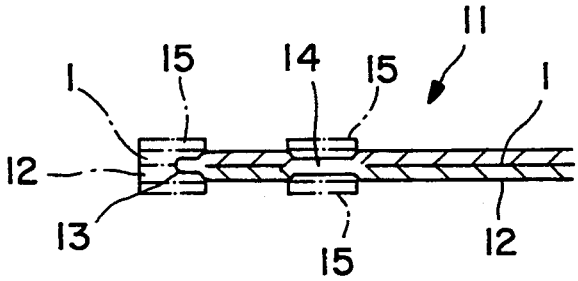
FIG. 15 is a partial sectional view showing the section of the fabric in FIG. 14 cut along line X—X.

FIGS. 14 and 15 show Embodiment 6, where a tablecloth 11 is prepared according to the present invention. A fabric 1 comprising natural fibers is provided on one surface thereof with a thermofusing nonwoven fabric 12. Thermofusing fibers are embroidred along the predetermined line 13 and hollow dot portions 14. The embriodered portions 15 are supersonically treated so that the temperature thereof increases and the treated portions of the nonwoven fabric 12 and the embroidered fibers melt and stick thereto. The fabric 1 and the nonwoven fabric 12 are melt-cut with a supersonic treating machine along the predetermined line 13, which is then protected from fraying with the melted fiber materials. The hollow dots 14 are also prepared by means of press welding with the supersonic treating machine, concurrently with the formation of the cut line 13.

In this embodiment a natural fabric 1 is provided with a nonwoven fabric 12 thereon, therefore, even if the embroidering with thermofusing fibers is provided coarsely, not packedly, on the fabric 1, the fibers in the nonwoven fabric 12 melt and stick onto the cut portions, securely protecting the cut portions from fraying. Such packed-type embroidering usually requires skilled work and is therefore a costly process. The present invention which does not require such strenious work can contribute to lowering the manufacturing cost.

After the melt-cutting and press welding processes, the remaining nonwoven fabric 12 can be cut and removed from the fabric 1. Two sheets of nonwoven fabrics, instead of one as in this embodiment, can be utilized, one on each surface of the fabric 1. The thermofusing nonwoven fabric 12 can be replaced by a thermofusing woven fabric comprising thermofusing fibers.

Embodiment 7

FIGS. 16 to 19 show Embodiment 7, in which another towel is prepared according to the present invention.

Figure 17:
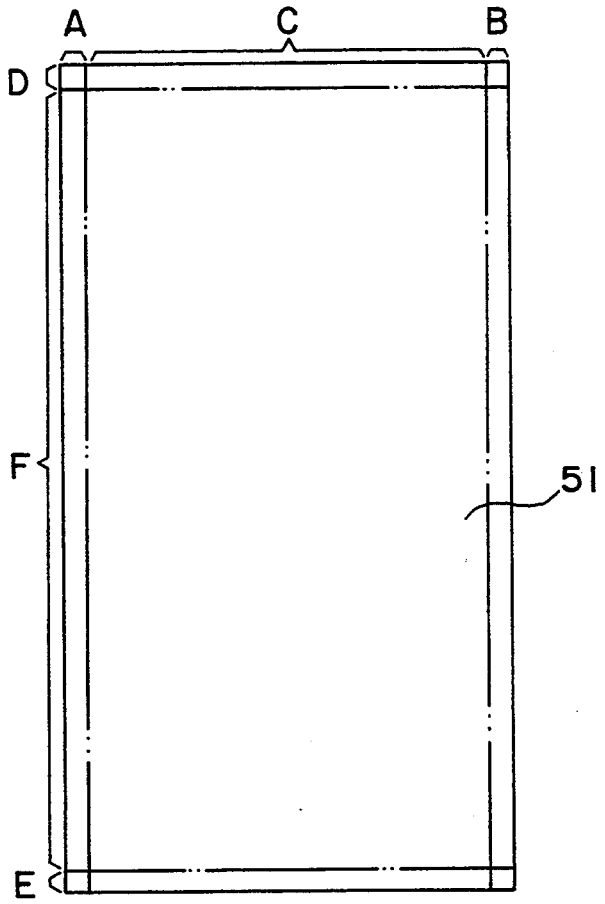
FIG. 17 is a plan view of a woven fabric to be supersonically treated according to the present invention.

FIG. 17 shows a woven fabric 51 comprising natural fibers. The warps in Zone A and Zone B are thermofusing fibers. The warps of Zone C are natural fibers. The wefts of Zone D and Zone E are thermofusing fibers. The wefts in Zone C are natural fibers. The Zone C×F comprises natural fiber warps and wefts. One surface or both surfaces of Zone C×F are treated so that pile loops are provided thereon to provide a better water absorption and touch feeling.

Figure 16:
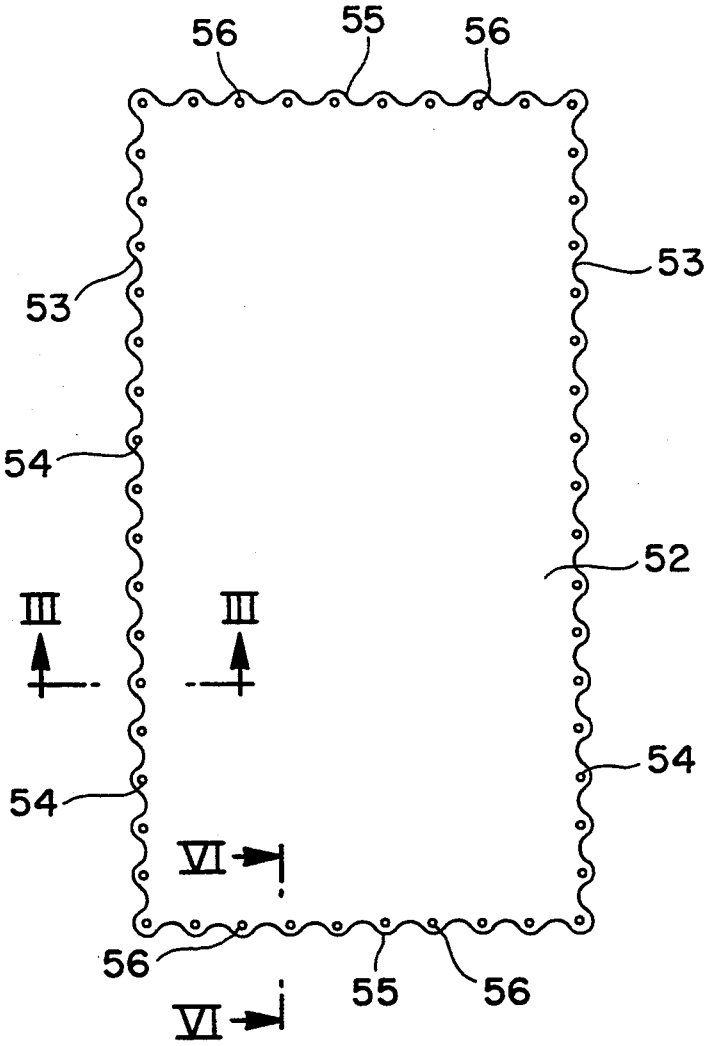
FIG. 16 is a plan view of another fabric prepared according to another embodiment of the present invention.

The woven fabric 51 is treated with a supersonic treating machine along the edge lines 53 and 54 and hollow patterns 54 as shown in FIG. 16.

Figure 18:
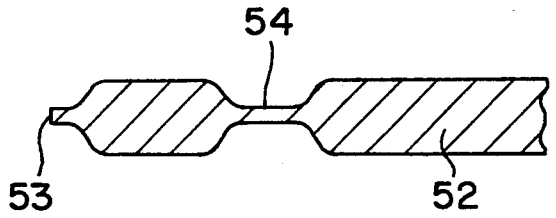
FIG. 18 is a partial sectional view showing the section of the fabric in FIG. 16 cut along line III—III.
Figure 19:
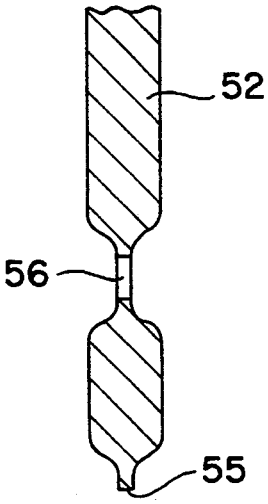
FIG. 19 is a sectional view showing the section of the fabric in FIG. 16 cut along Line VI—VI.

FIG. 18 shows a partial section as cut in line III—III of FIG. 16, and FIG. 19 shows a partial section as cut in line VI—VI of FIG. 16.

The supersonic treating machine used in this embodiment can be either a supersonic sheet treating machine 20 or a supersonic edge ornamentation machine 30.

Towels made in accordance with this embodiment do not fray on their edges without any further conventional fray preventive treatment.

Embodiment 8

Figure 20:
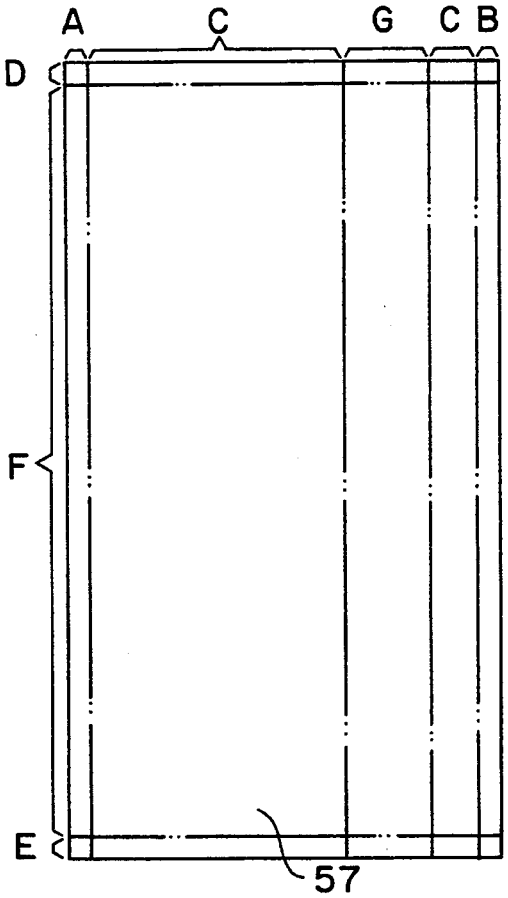
FIG. 20 is a plan view of another woven fabric to be supersonically treated according to another embodiment of the present invention.
Figure 22:
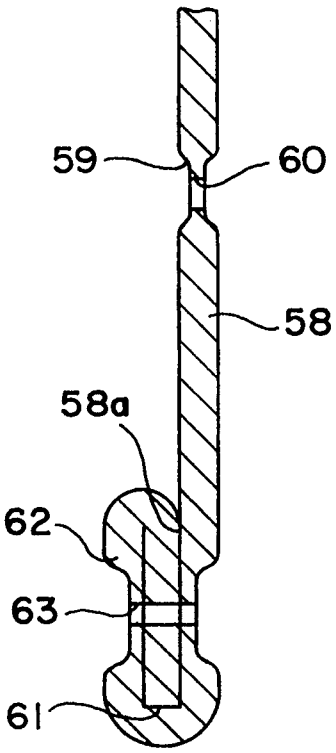
FIG. 22 is a partial sectional view showing the section of the fabric in FIG. 21 cut along line XI—XI.
Figure 21:
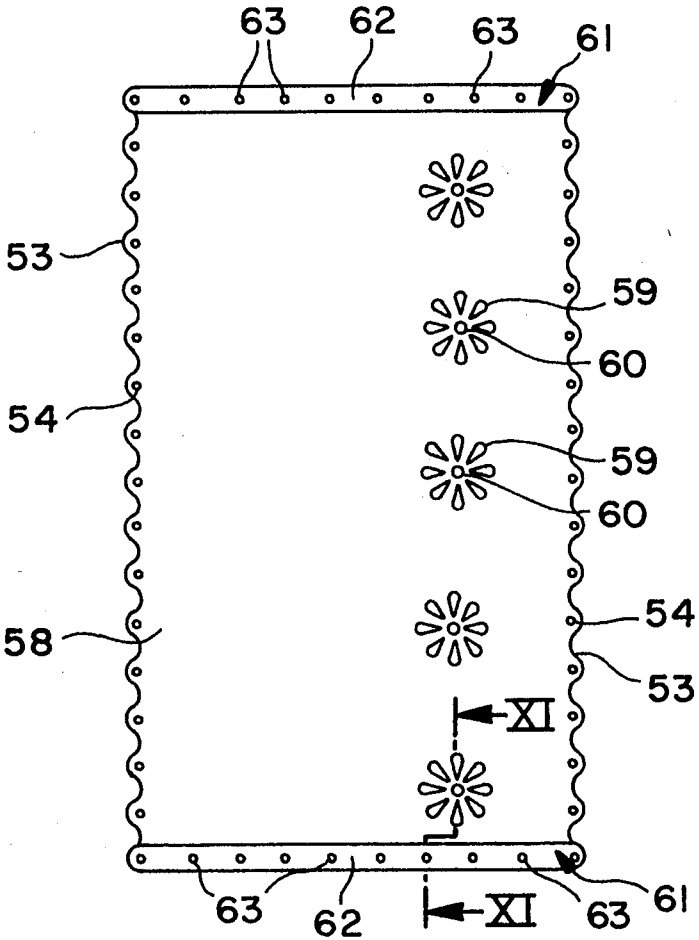
FIG. 21 is a plan view of another fabric prepared according to another embodiment of the present invention.

FIGS. 20–22 show another embodiment of the present invention as Embodiment 8, which differs from Embodiment 7 slightly by additionally providing the woven fabric 57 with thermofusing wefts in Zone G as shown in FIG. 20. Zone G is then provided with flowery patterns 59 and holes 60 as shown in FIG. 21 to prepare a towel with a hollow flowery design.

Both the edges 61 of the towel fabric 58 are cut with a cutting means or using a supersonic treating machine and bent inside to form the lapel portions 62. Throughholes 63 are provided through the lapel portions 62 close to the bent edges 61 with a supersonic treating machine so that the lapel portions 62 become frayless and tough. The flower portions 59 are made hollow and the flower portions 60 are holes as shown in FIG. 22, which shows the section as cut along line XI—XI in FIG. 21.

Towels thus made do not practically lose their water absorptiveness or soft feeling and are resistant to frequent washing in addition to being frayless.

The configuration of edge lines, patterns and openings (holes) can be modified according to individual tastes, and products other than those introduced so far in the above description can also be made according to the present invention, which are characterized by being frayless without conventional bulky sewn lapel portions, richer in variety of designs and more economical and less strenious to manufacute than the conventional counterparts.

Accordingly, the present invention may be embodied in other specific forms without departing from the spirit or essential charasteristics thereof. The present embodiments are therefore to be considered in all aspects as illustrative and not restrictive, the scope of the invention being indicated by the appended cl aims rather than by the foregoing description, and all changes which come within the meaning and range of equivalence of the claims are therefore intended to be embraced therein.

What is claimed is:

1. A fabric to be utilized in making a textile product, prepared in the steps comprising:

(a) providing at least one surface of a natural fabric with a thermofusing fabric to form a fabric assembly; and (b) pressingly welding along a predetermined pattern on the fabric assembly with a supersonic treating machine to provide a frayless arrangement including hollow patterns.

2. A fabric to be utilized in making a textile product, prepared in the steps comprising:

(a) providing at least one surface of a natural fabric with a thermofusing fabric to form a fabric assembly;

(b) embroidering said fabric assembly along a predetermined pattern thereon with thermofusing fibers; and c) melt-cutting or pressingly welding along said embroidered pattern with a supersonic treating machine to provide a frayless arrangement including hollow patterns.

3. A fabric to be utilized in making a textile product, prepared in the steps comprising:

(a) blending periphery zone portions of a natural fabric with thermofusing fibers; and (c) melt-cutting or pressingly welding along a predetermined pattern also within said periphery zone portions with a supersonic treating machine to provide a frayless arrangement including hollow patterns.

4. A fabric to be utilized in making a textile product, prepared in the steps comprising:

(a) blending a portion of a natural fabric with thermofusing fibers; and (b) melt-cutting or pressingly welding said blended portion along a predetermined pattern with a supersonic treating machine to provide an arrangement including hollow patterns.

* * * * *